United States Patent [19]

Aichinger

[11] 4,033,472

[45] July 5, 1977

[54] CLOSURE FOR CONTAINERS

[75] Inventor: Dietmar Aichinger, Arlesheim, Switzerland

[73] Assignee: Albert Obrist AG, Reinach, Switzerland

[22] Filed: Apr. 8, 1975

[21] Appl. No.: 566,096

[30] Foreign Application Priority Data

Aug. 19, 1974 Switzerland ..... 11218/74
Nov. 9, 1974 Switzerland ..... 15217/74

[52] U.S. Cl. ..... 215/256; 215/258; 215/356

[51] Int. Cl.[2] ..... B65D 41/34; B65D 41/40

[58] Field of Search ..... 215/246, 250, 251, 252, 215/253, 254, 255, 256, 258, 324, 326, 329, 356

[56] References Cited

UNITED STATES PATENTS

| | | | |
|---|---|---|---|
| 3,189,208 | 6/1965 | Jowett | 215/246 |
| 3,438,529 | 4/1969 | Lohrer | 215/253 X |
| 3,441,161 | 4/1969 | Van Baarn | 215/252 X |
| 3,673,761 | 7/1972 | Leitz | 215/253 X |
| 3,720,343 | 3/1973 | Irish, Jr. | 215/246 |
| 3,788,509 | 1/1974 | Keeler | 215/324 |
| 3,812,991 | 5/1974 | Wurl | 215/252 |
| 3,929,246 | 12/1975 | Leitz | 215/252 |

*Primary Examiner*—Stephen Marcus
*Attorney, Agent, or Firm*—Larson, Taylor & Hinds

[57] ABSTRACT

A closure comprising a cap and downwardly depending band or skirt severable therefrom along a substantially annular predetermined tear line is disclosed. The band provides a tamper-proof or guarantee type closure. At least the band is made of heat deformable thermoplastic material whereby after positioning of the cap on the container the band is heat deformed to tightly encircle the container.

17 Claims, 5 Drawing Figures

CLOSURE FOR CONTAINERS

The present invention relates to a closure for containers, consisting of a cap having a depending band or skirt of deformable synthetic plastic material severable along an approximately annular or circular predetermined tear line; the band after fitting of the cap on the container coming into shape-locking engagement with a bead or recess provided adjacent the opening of the container as a result of deformation of the band by the application of heat. The band effectively provides means for retaining the cap on the container and additionally acts as a tamper-proof or guarantee band.

The present invention also relates to a method for positioning the cap and depending skirt or band on a container.

Closures of this general type are already in limited use and are described for example in Swiss Pat. No. 505,005.

One great disadvantage of such known closures, however, is that the band is of such configuration in cross-section that expensive, radially opening injection-molding tools have to be used for the production of the closure from thermoplastic plastic material. Additionally, such known bands have such relatively great mass that deformation around the neck of the container takes place only as a result of the use of mechanical tools under relatively high pressure.

The present invention avoids the problems and disadvantages of the prior art by providing a closure for containers and a method for the application of such closures, which enables simpler, more economical and more rapid production of the closure cap and additionally simplifies the fitting of the cap closure on the container.

According to one embodiment of the invention, this is primarily achieved in that the inner walls of the cap and band are so adapted to the outer wall of the container neck that the band abuts firmly on the container neck in the region of the predetermined tear line before hot deformation. Thus, in an optimally simple manner it is ensured that during the heating (and deformation) operation in the fitting of the closure on the container neck, the band, the cross-section of which is greatly reduced at the predetermined tear line, is protected against excessive heating, since heat is conducted away by the abutment or bead on the container neck. In this manner, for the heating of the band, hot air possibly can be directed under pressure against the band in such a way that a part of the band is plastically deformed and comes into engagement with the bead provided on the container neck, without mechanical aids and exclusively under the influence of the hot air although this is not the preferred embodiment. If here the cross-section of the band increases downwardly in wedge form or slightly concavely or convexly from the predetermined tear position to the lower edge of the depending band or skirt the cap with the band can readily be produced in a simple injection-molding tool and expelled without radial opening of the tool, without fear of tearing at the predetermined tear line.

The invention can be realized especially advantageously if the band is made somewhat wedge-shaped in cross-section, the point or apex of the wedge representing the connection of the cap and depending band or skirt.

The invention can be realized particularly advantageously if the cap and band are similarly produced from thermoplastic synthetic plastic material. However, and especially in the case of screw cap closures it is possible to produce the screw cap from any desired other material and to provide a thermally deformable depending band on its lower end.

The practical realization of the embodiment discussed above especially also offers the advantage that the closure can be fitted readily to screw-threaded bottles presently in use which have a bead around which the band is to be deformed with a tolerance of heights of up to 2mm. In this latter case, the advantages of the invention are well pronounced in comparison with known methods for the production of tamper-proof closures, some of which provide almost insoluble problems of adaptation for compensation in height tolerances.

The objects of the invention are achieved according to a further embodiment wherein the depending band or skirt thickens uniformly downwardly from the predetermined tear line at an angle of less than 90°. This results in two distinct advantages.

Firstly, due to the increase in thickening of the band at an angle of less than 90°, the use of simpler tools without jaws is rendered possible, and secondly, the mass of the band is reduced in such a way that simple deformation of the band is possible even in the case of rapid closure operations. According to the elasticity and tear resistance of the utilized synthetic plastic material and to the formation of the predetermined tear line, it is expedient to make the angle of increase less than 60°, or possibly even less than 30°.

Small angles of increase, which in individual cases can also be made to incline slightly concavely or convexly, have proved their value especially when a line of perforations is provided as the predetermined tear line between cap and band.

The band can be heated and thus the closure produced especially quickly if the outer wall of the container and/or the band are formed in such a way that a downwardly open gap exists between the container wall and the band before hot deformation, which gap on the one hand renders possible good deformation of the band and on the other hand renders possible the heating of the band on the inner side, that is the side facing the container, whereby the heating operation is shortened.

The band can be torn open simply and without excessive force if in addition to the predetermined tear line a second vertically extending predetermined tear line is provided. This second tear line effects a breaking open of the band as soon as the latter is pulled upwardly over the bead provided on the container during opening of the closure. Of course, in place of a bead the band could also be deformed into a depression provided in the container neck, in which case the upper edge of this depression may act as a bead to break the band during opening.

Especially in the case of re-usable containers, it is desirable that the band remain on the cap after the container is opened, and not to have to be severed separately from the container. In this case, it is desired that the horizontal predetermined tear line between cap and band is interrupted by a firm web at one point at least, which holds the band connected with the cap even after tearing open.

The invention will now be described in greater detail with examples of preferred embodiment by reference to the accompanying drawings, wherein.

Detailed reference will now be had to the accompanying drawings wherein the like reference numerals refer to like parts.

Figure 1:
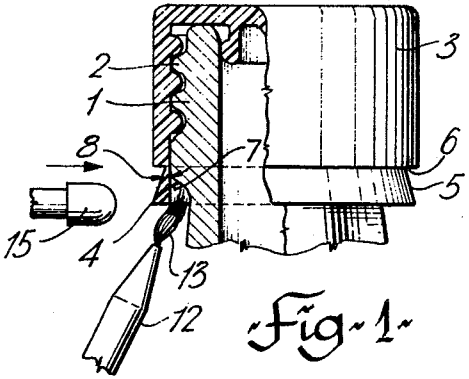
FIG. 1 is a diagrammatic illustration of the container closure including some embodiments of the invention in partial sectional view.

As represented in partial view in FIG. 1, a cylindrical container neck 1 has threading 2 on which a cap 3 produced from thermoplastic material is positioned. The container neck 1 has a bead 4 over which band 5 is deformable.

As illustrated in FIG. 1, the angle 8 of increasing thickness of the band 5 is less than 30°, enabling the cap 3 together with the band 5 to be produced without difficulty in one piece in an injection mold without radial opening jaws.

Figure 3:
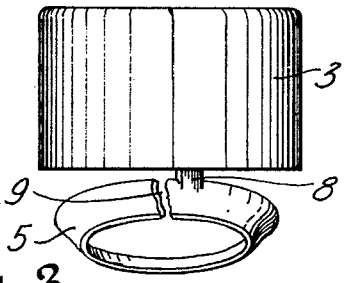
FIG. 3 shows the cap of the closure according to FIG. 2 removed from the container.
Figure 2:
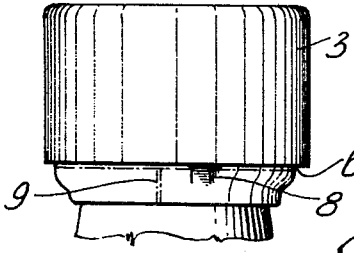
FIG. 2 shows in side view closure according to the invention fitted on a container.

The dimensioning of the angle 8 is of particular importance because, as may also be seen from FIGS. 2 and 3, the predetermined tear line or indentation 6 is provided which precludes the application of excessive forces to the band 5 (which could occur in the case of greater undercuttings) in the ejection of the cap 3 from an injection mold.

For the deformation of the band 5 a nozzle 12 with hot air 13 is directed as illustrated into the gap 7 between the container neck 1 and the band 5 and then by the application of pressure of tool 15 the band 5 is pressed against the container neck 1 and thus durably deformed.

In place of hot air, of course, other heating mediums could be used, as for example, gas flames or even laser beams.

It will be seen from FIG. 2 how the band 5 is deformed around the bead 4, thus rendering opening of the closure impossible without damage to the band. For firm connection of the band 5 with the cap 3 a non-weakened area or web 8 may be provided which connects the band 5 with the cap 3 even after the removing of the cap 3 from the container neck 1, and thus prevents the necessity of having to sever the band 5 from the container neck 1 after opening.

To simplify this latter operation, an additional vertical predetermined tear line 9 may be provided on the band 5, which additionally simplifies the breaking open of the band 5 and thus the opening operation.

Figure 4:
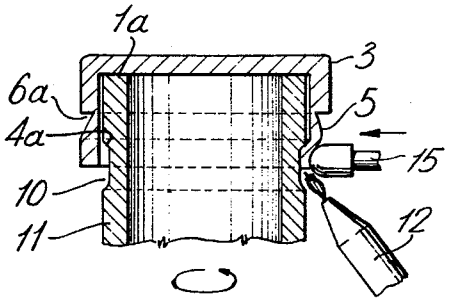
FIG. 4 shows a closure being positioned on a container or bottle.

FIG. 4 shows a modified example of the invention in which an annular depression 10 is provided adjacent the upper edges 1*a* of a container 11, in place of a projecting bead as shown in FIG. 1.

However, as may be seen the upper edge 4*a* of the depression 10 acts as a bead for the band 5 in the same way as the bead 4 in the embodiment according to FIG. 1.

For the fitting of the cap 3 to the container 11 the latter, as indicated diagramatically, is set in rotation about its longitudinal axis and at the same time a gas flame (or suitable heating medium) is directed through nozzle 12 against the band 5. The gas flame here impinges from obliquely beneath upon the band 5 in such a way that the latter is heated both on its inner side and at the same time to a somewhat lesser extent on its outer side. In this way, extraordinarily rapid heating of the band 5 is achieved, so that directly after the heating by the gas flame a presser roller 15 can be pressed against the band 5 for its permanent deformation.

It will be noted from FIG. 4 that the line of weakening 6*a* is not provided with perforations of any kind and that the weakness is provided by the thinness of the material.

This ensures that after the pressing of the band 5 into the depression 10 the container 11 is firmly closed and also that no impurities of any kind can penetrate into the container, for example, through a perforated predetermined tear line.

Since this predetermined tear line, formed merely as a narrowing of material, is moreover capable of greater stressing, the angle of increase with which the band 5 increases in thickness downwardly from the predetermined tear line 6*a* can be formed as illustrated at an angle of about 45°, without danger of the band 5 being torn from the cap 3 in the expulsion from the injection-molding tool.

In place of the presser roller 15, of course, clamping jaws, presser strips or other mechanical aids can be used to deform the band 5 inwardly. The use of compressed air or other preferably heated media directed under heavy pressure against the band may be possible for material deformation.

Due to the fact that heat is directed from obliquely beneath against the band, it is ensured that the latter is heated on the inner surface more than on the outside, whereby damage to the surface of the band in deformation is avoided.

Moreover, the lower edge of the band is subjected to a greater supply of heat than the thinner region in the vicinity of the predetermined tear line.

Thus, in the simplest manner it is possible to ensure uniform and rapid heating to the deformation temperature.

Figure 5:
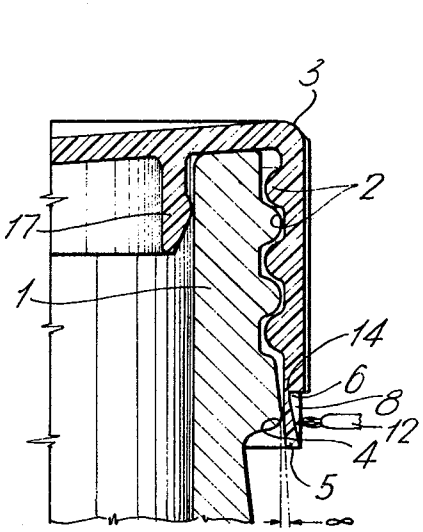
FIG. 5 illustrates in side partial sectional view the positioning of a closure according to a further embodiment onto a container.

FIG. 5 illustrates a further embodiment of the invention concept. This drawing shows a partial section through a bottle neck 1 and a closure 3 possessing features of the invention. A screw cap 3 is placed upon a bottle neck 1 with both the screw cap 3 and bottle neck 1 being provided with screw threadings 2. A band 5 of approximately wedge-shaped formation is produced in one piece with the screw cap 1 from thermoplastic material, the predetermined tear line 6 being adjacent to the lower and inner edge 14, of the bottom of the screw cap 3.

As illustrated the inner wall of the band 5 has an approximately conically widening inclination — see angle ∞.

A portion of the band 5 here lies firmly against the bead 4 of the bottle 1 in such a way that when hot air is applied under high pressure from a nozzle 12, only the lower part of the band 5 is plasticized and pressed in shape-locking manner about the bead 4. In the region of the predetermined tear line 6 heat is conducted away from the band 5 by the bottle 1.

As may be seen, the form of the band 5 tapering in wedge form downwardly renders possible withdrawal of the cap 1 as illustrated from an injection molding tool without having to open the tool.

In the first molding operation, the threading area is removed from the mold in the longitudinal direction, and in the second step the cap 1 is pushed out of the outer mold part by pressure upon the inner crown. The band 5 is only insubstantially stressed in this operation, since due to the wedge-shaped formation it provides no excessive resistance to its removal from the mold, and furthermore it can yield elastically inwardly since the inner mold is removed first.

As one familiar in the art will appreciate, there is no difficulty in determining the pressure and temperature of the hot air flowing from the nozzle 12 for the purpose of adaptation to the particular thermoplastic material utilized and its behaviour under the influence of heat.

The adaptation of the depth of the skirt or band 5 to any reasonable tolerances is also possible without difficulty, as will be appreciated.

In place of the arrangement of the single nozzle 12, which requires the rotation of the cap 3 for the application of hot air (or other heated medium) over the entire periphery of the band 5, it is of course possible in order to shorten the procedure to provide a plurality of nozzles 12 (not shown) or to provide nozzles of slot form (not shown) around the entire periphery of the screw cap 1 or at least over a part of the periphery thereof.

In specific cases of application it is also possible to provide the closure according to the invention even in the case of caps without screw threading as specifically shown in FIG. 4.

As indicated in the drawings, additional positive sealing of the container with the cap may be facilitated by the provision of a suitable stopper plug 17 and/or suitable sealing contact between the edge 1*a* and contacting portion of the cap 1 as by way of a seal or washer integral with the cap (not shown) as known in the art.

I claim:

1. A closure for containers consisting of a cap having a downwardly depending band at least partially severable therefrom along a substantially annular predetermined tear line, at least the depending band being of heat deformable thermoplastic material, the depending band increasing in thickness downwardly from the predetermined tear line, the depending band after positioning of the cap on a container being heat deformable into shape-locking engagement with the container, said band as it increases in thickness being devoid of abrupt changes in the contour of its walls such as would preclude axial removal of the cap and band from a nonexpanding mold engaging the band during formation in a molding process.

2. A closure as claimed in claim 1 wherein the maximum angle of increase in thickness at any point along the outer wall of said band is less than 60°.

3. A closure as claimed in claim 1 wherein, apart from said tear line, the inner wall of said band is an axial cylindrical continuation of the inner wall of said cap.

4. A closure as claimed in claim 1 wherein the maximum diameter of the band is no greater than the maximum diameter of the cap.

5. A closure according to claim 1 wherein at least part of the depending band is wedge-shaped in cross-section, with the apex of the web adjacent said tear line.

6. A closure according to claim 1, wherein the predetermined tear line is interrupted at one point at least by a web permanently connecting the band with the cap.

7. A closure according to claim 1, wherein the band has a substantially vertical second predetermined tear line extending the height thereof.

8. A closure according to claim 1, wherein the predetermined tear line is interrupted at one point at least by a web permanently connecting the band with the cap, and wherein the band has a substantially vertical second predetermined tear line positioned beside the said web.

9. A closure according to claim 1 wherein the angle of increase in thickness is less than 60°.

10. A closure according to claim 9 wherein the angle of increase is less than 30°.

11. A closure according to claim 1 in combination with and mounted on a container, wherein the container has a downwardly facing surface adjacent its open end, the depending band being heat deformed into shape-locking engagement with the surface.

12. A closure according to claim 11, the band and container being so formed before deformation as to provide a downwardly opening gap therebetween prior to heat deformation of the band.

13. In combination, a container and a closure cap having a downwardly depending band at least partially severable therefrom along a substantially annular predetermined tear line, at least the depending band being of heat deformable thermoplastic material, the depending band after positioning of the cap on the container being heat deformable into shape-locking engagement with the container, the inner surfaces of the cap and band being adapted to the outer surface of the container whereby before heat deformation the band abuts firmly on the container in the region of the predetermined tear line, and said region of the band is protected against excessive heating by heat conduction into the abutting container.

14. A closure according to claim 13, the inner surface of the band before deformation being of downwardly opening conical configuration, the inner lower edge of the cap being in alignment with the predetermined tear line.

15. A closure according to claim 13, the cross-section of the band before deformation increasing downwardly from the predetermined tear line to the lower edge of the band.

16. A closure according to claim 13, wherein the band before deformation has a downwardly smoothly widening wedge-shaped configuration, the point of the wedge being secured to the cap at said predetermined tear line.

17. A closure according to claim 13, wherein the cap is a screw cap.

* * * * *